United States Patent [19]

Amminger

[11] 4,190,399

[45] Feb. 26, 1980

[54] REGENERATIVE TURBINE

[76] Inventor: William L. Amminger, 239 Ridgefield, Memphis, Tenn. 38111

[21] Appl. No.: 906,424

[22] Filed: May 16, 1978

[51] Int. Cl.[2] ..... F01D 25/00; F01K 25/06

[52] U.S. Cl. ..... 415/116; 415/213 T; 415/53 T; 60/649; 60/685; 60/689

[58] Field of Search ..... 60/649, 685, 688, 689; 415/52, 53 T, 213 T, 198.2, 116

[56] References Cited

U.S. PATENT DOCUMENTS

| | | | |
|---|---|---|---|
| 3,441,201 | 4/1969 | Hollenberg | 415/116 |
| 3,973,865 | 10/1976 | Mugele | 415/53 T |
| 4,089,177 | 5/1978 | Olofsson | 60/685 |

*Primary Examiner*—Allen M. Ostrager

[57] ABSTRACT

A method and apparatus for providing an improved regenerative turbine driven by a liquid or gaseous fluid. The turbine has a housing with a primary inlet and an auxiliary inlet. The driving fluid in the primary inlet is maintained at near stagnation pressure conditions. As the primary driving fluid passes through the regenerative turbine motor channel, it describes a helical path, imparting energy from the fluid to the rotor. The auxiliary fluid inlet feeds fluid to the exhaust part of the rotor channel tangential to the helical path of the primary fluid and increases the rotational motion of the exhaust fluid. The pressure ratio between the fluid inlet and the fluid exhaust is thereby increased and results in improved turbine efficiency. Secondary sources of energy for driving the turbine provide alternative driving fluids.

14 Claims, 6 Drawing Figures

REGENERATIVE TURBINE

BACKGROUND OF THE INVENTION

This invention relates generally to turbines, and more particularly, to a method and apparatus for providing regenerative turbines with augmented fluid motion in the exit portion of the turbine rotor channel.

Regenerative turbines are inherently low efficiency rotary machines, but they may be used advantageously where fluids with low flow rates and relatively high pressure ratios are available. In a regenerative turbine, regeneration takes place in the peripheral region of a rotor by radial reentry of fluid into the rotor. Regenerative turbines have best efficiency at low rotor speeds and low fluid flow speeds. The low rotor speed of this type of turbine in relation to the speed of the device being driven allows the turbine rotor shaft and the device being driven to be easily coupled, resulting in simple initial construction and increased operating reliability. The inherent low speed of regenerative turbines permits the safe operating limits of bearings and rotor components to be much lower than those of high speed turbines. For example, higher fluid tempertures, when necessary, are permitted in a regenerative turbine using a particular component than are permitted in a high speed turbine using the same component. Regenerative turbines are used where small amounts of mechanical power are extracted at low rotational speeds from high pressure or high temperature energy sources. Regenerative turbines have large flow passages and do not require critical dimensional tolerances for the components thereof. The rotor blades are simplified in construction and the rotor channels do not require vanes or blades. One or more columns of rotor blades are arranged around the circumferences of the rotor with the blade working surfaces extending parallel to the axis of the cylindrically shaped rotor body. Regenerative turbine structures are generally light in weight and simple in design resulting in economical construction costs and simplified maintenance.

As fluid flows through a regenerative turbine rotor and the channel adjacent to the rotor, the fluid flow generally traces a helical path for each column of blades. Regenerative turbines may have simplified blade structures because energy transfer between the fluid and the rotor is accomplished by frictional forces exerted by the fluid upon the rotor with the rotor being dragged along by the fluid stream. In a regenerative turbine regeneration action occurs over the rotor periphery by a mixing of the rotor fluid stream and the channel fluid streams. The fluid flow can be visualized as split into two components, a through component and a circulatory component. The circulatory component for each column of blades describes a spiral screw-like path with the fluid passing through the rotor and the adjacent channel several times. The number of fluid passes through the turbine is zero at turbine runaway conditions and increases to a maximum at stalling conditions which also produces the greatest torque.

The need has arisen in recent years for a turbine which operates effectively in naturally occurring low velocity fluid mediums such as rivers and wind streams. Improvements in regenerative turbine designs provide for extraction of greater amounts of useful energy from these virtually untapped sources of renewable energy.

SUMMARY OF THE INVENTION

Accordingly, it is an object of this invention to provide an improved regenerative turbine apparatus and a method for improving operation of a regenerative turbine by augmented introduction of fluid into the exit portion of the turbine.

It is another object of the invention to provide a turbine which operates with low specific fluid speeds.

It is another object of the invention to provide an economically produced device for extracting energy from natural fluid energy sources such as rivers and wind streams.

It is another object of the invention to provide a regenerative turbine which has provisions for introduction of energy from a secondary energy source.

Briefly, the invention provides an improved fluid-driven regenerative turbine which includes a rotor mounted within a rotor channel of a housing. The rotor channel has a primary fluid inlet region and a fluid outlet region. Some of the primary driving fluid transfers its energy to the rotor and follows a helical path through the rotor channel. Driving fluid is provided to the rotor primary fluid inlet region from a primary fluid inlet channel in the housing. An auxiliary fluid inlet channel in the housing provides auxiliary fluid to the rotor channel outlet region in a direction which is tangential to the helical path of the primary fluid in the rotor channel outlet region, intensifying the helical motion of the primary fluid. According to one aspect of the invention, a first nozzle is between the primary fluid inlet channel and the rotor channel inlet region. According to another aspect of the invention, the primary inlet channel fluid is maintained at near stagnation conditions. According to another aspect of the invention, the rotor includes a plurality of radial rotor blades arranged in one or more columns on the rotor. According to another aspect of the invention, fluid leakage between the rotor primary driving fluid inlet region and the rotor fluid outlet region is minimized by a separation block extending from the housing to near the rotor. According to another aspect of the invention, the housing is pivotably mounted to a base so that the fluid inlet channel is alignable for receiving driving fluid from a source of fluid having a variable direction of flow. According to another aspect of the invention, a secondary source of a secondary driving fluid is introduced by a second nozzle into the primary fluid inlet region of the rotor channel. According to another aspect of the invention, a plurality of rotors are coupled to a shaft, each rotor having auxiliary fluid provided thereto. According to another aspect of the invention, the rotor channel cross-sectional area increases from the primary fluid inlet region to the fluid outlet region. Another aspect of the invention includes closed-cycle fluid flow, returning fluid from the turbine outlet to the turbine inlet through a heat sink, pump, and heat source.

The method of providing improved operation of a regenerative turbine having one or more rotors which includes introducing an auxiliary fluid flow into the rotor channel outlet in a direction tangential to the helical path of the primary driving fluid associated with each rotor. According to another aspect of the inventive method a secondary driving fluid is also provided to one or more of the turbine rotor inlets.

DESCRIPTION OF THE DRAWINGS

For a more complete understanding of the invention reference is made to the drawings in which.

DESCRIPTION OF THE PREFERRED EMBODIMENTS

Figure 1:
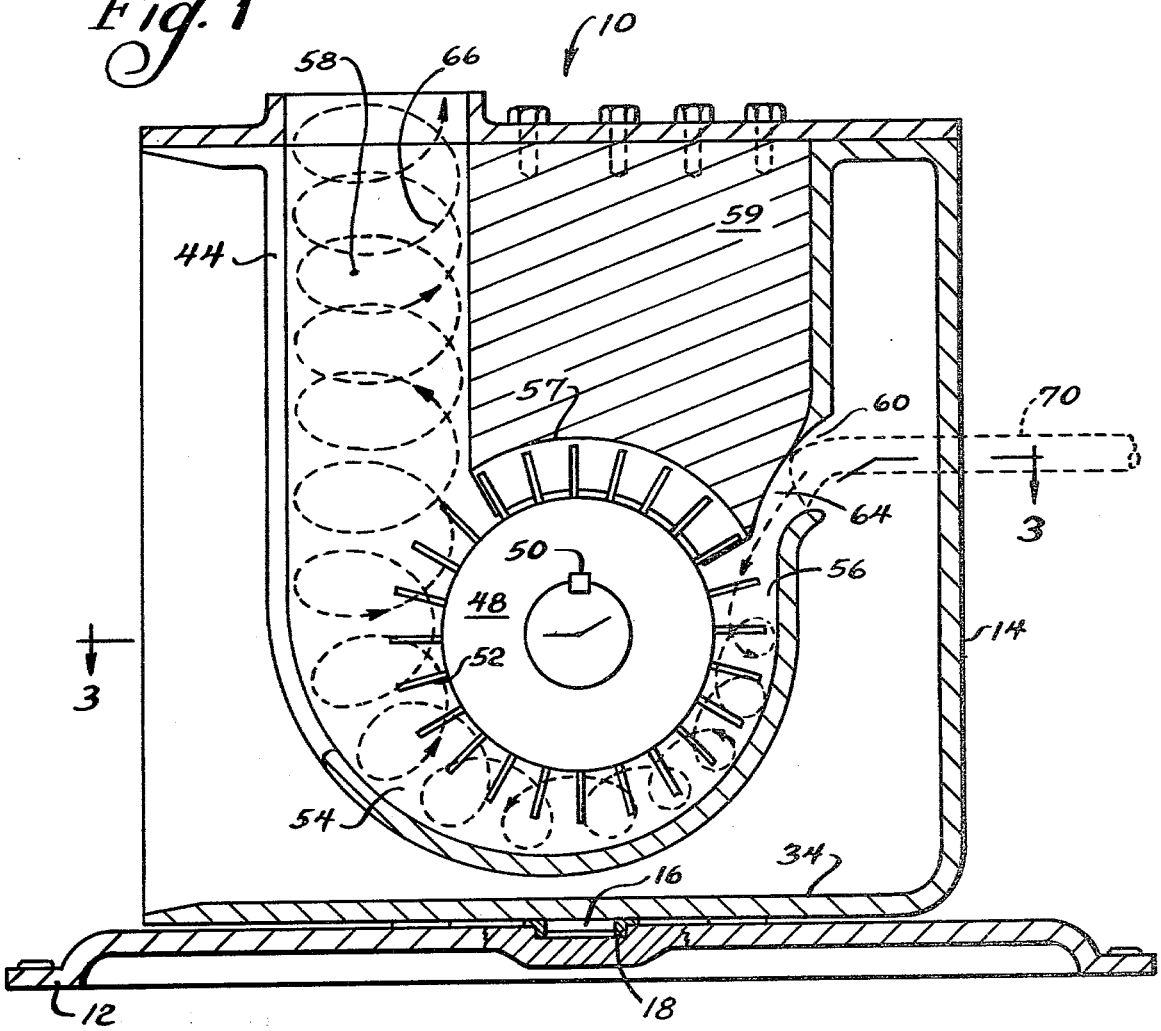
FIG. 1 is a cross-sectional elevation view of a regenerative turbine according to the invention with a perspective view of a fluid flow streamline.

Referring to FIG. 1 of the drawings, a regenerative turbine assembly 10 includes a base 12 to which is pivotally attached a turbine housing 14 by a suitable pivot means which includes, for example, a pin 16 affixed to the housing 14 and journalled in a sleeve bearing 18 contained in the base 12, permitting the turbine housing 14 to rotate about an axis generally perpendicular to the plane of the base 12. This permits the turbine housing to be pivoted so as to optimize the orientation of the turbine assembly 12 with respect to a source of driving fluid. Orientation of the turbine may be accomplished by means known in the art such as, for example, vanes and the turbine housing configuration (not shown). The driving fluid is, for example, an air current or a water flow which may shift direction of flow. The turbine housing 14 forms an exterior enclosure for the various parts of the regenerative turbine assembly structure which will be hereinbelow described.

Figure 2:
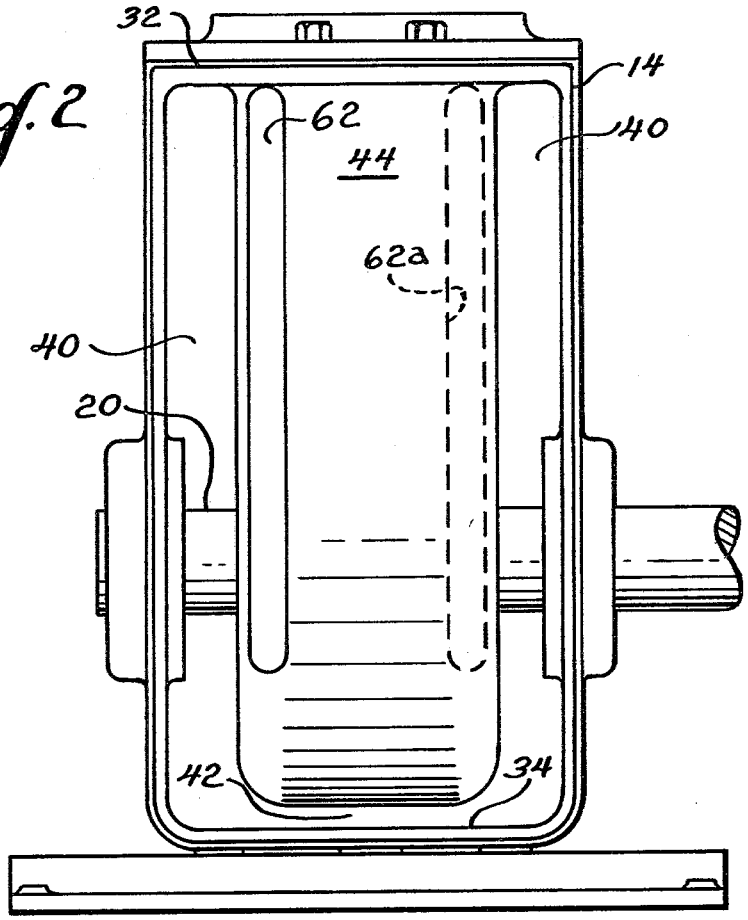
FIG. 2 is a side elevation view of a regenerative turbine according to the invention.
Figure 3:
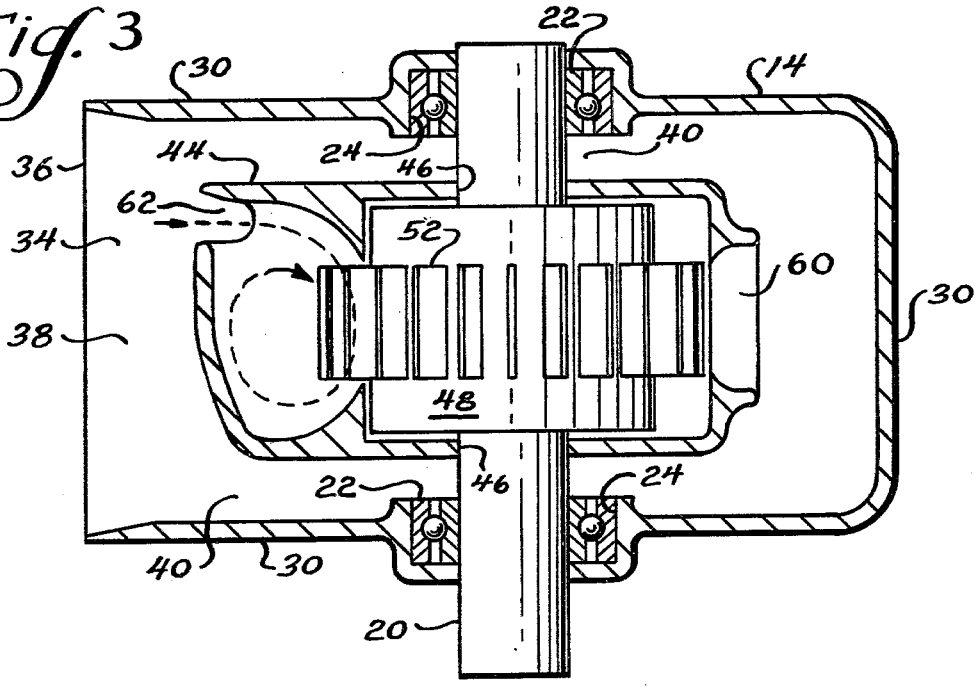
FIG. 3 is a sectional view of a regenerative turbine taken along section line 3—3 of FIG. 1.

Referring to FIG. 2 and FIG. 3 of the drawings, a shaft 20 is rotatably supported within the turbine housing 14 by bearing means, which in this embodiment of the invention are ballbearing assemblies 22 having the outer races thereof contained within cavities 24 formed in opposite walls of the turbine housing 14. The shaft 20 may deliver torque through an appropriate coupling device (not shown) to, for example, an energy storage device such as, for example, a flywheel (not shown). Power may be taken from the shaft by other means well known in the art.

The turbine housing 14 has three outer walls 30 which along with the top wall 32 and the bottom wall 34 of the housing form an enclosure for the turbine assembly. The open remaining side 36 of the enclosure formed thereby is open to receive fluid flow. Fluid for driving the turbine is obtained, for example, from an air current or a water current. Fluid enters the turbine through the large inlet 38 formed by the side walls 30, the top wall 32, and the bottom wall 34 of the turbine housing 14. Referring to FIG. 3 of the drawing, fluid enters the turbine at the large inlet 38 and passes through two side channels 40 and a bottom channel 42 as shown in FIG. 2 and FIG. 3 of the drawings. These channels are formed between the interior surfaces of the walls of the turbine housing 14 and a rotor housing 44. The rotor housing 44 is a generally box-shaped structure which is affixed to the turbine housing 14 at the top wall 32 thereof.

Figure 6:
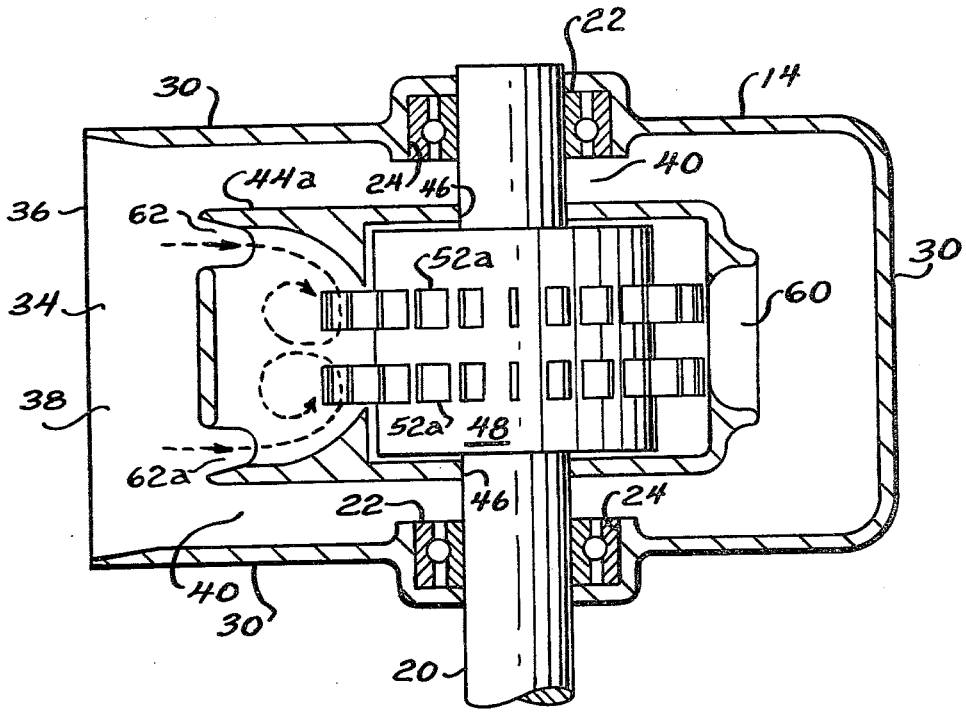
FIG. 6 is a sectional view of a regenerative turbine similar to the view of FIG. 3 with two columns of rotor blades.

The shaft 20 extends through apertures 46 formed in opposite walls of the rotor housing 44. A cylindrical rotor structure 48 is fixed to the shaft 20 by a key 50 as shown in FIG. 1 of the drawing. The rotor structure 48 includes a single column of plate-like rotor blades (typically shown as 52) radially extending from the rotor and arranged around the circumference of the rotor as shown in FIG. 3 of the drawings. FIG. 6 shows two columns of blades **52*a* spaced adjacent to a central clear area. The blades are arranged on both sides of the rotor, leaving a bladeless space on the rotor periphery in the center. The interior wall surfaces of the rotor housing 44 in the embodiment of FIG. 3 form the boundaries for a rotor fluid channel 54. As shown in FIG. 1 of the drawings, the rotor fluid channel 54 has a cross-sectional area which gradually increases from an inlet region 56 to an outlet region 58. Alternatively, the fluid channel 54 cross-sectional area may be constant. A separator portion 59 extends from the top of the rotor housing 44 toward the rotor structure 59 and terminates in a curved end surface 57, which is spaced a small distance away from the path of the tips of the rotor blades 52** and which extends around the rotor blades toward the rotor body.

The rotor housing 44 contains a primary fluid inlet 60 to the rotor fluid channel 54. A long narrow slot forms an auxiliary fluid inlet 62 in the wall of the rotor housing 44 adjacent to the large inlet 38 and opposite the primary fluid inlet 60. A single auxiliary fluid inlet 62 is used with a rotor having one column of blades as shown in FIG. 3. A second slot **62*a*** forms a second auxiliary fluid inlet provided when two columns of rotor blades are utilized as in FIG. 6 of the drawing.

In operation, fluid enters the side channels 40 and the lower channel 42 and is maintained at a near stagnation condition so that high pressure conditions exist therein even though some of the fluid flows through the primary fluid inlet 60. The efficiency of a regenerative turbine is determined by the ratio between the inlet and the outlet pressures. Improved efficiency for this type of turbine have been achieved with a pressure ratio of three to four. Maintaining the fluid in the large turbine inlet 38 at a near stagnation condition improves the efficiency of the turbine.

A nozzle 64 formed in the rotor housing 44 accelerates the fluid entering the rotor fluid channel 54. Fluid enters the space swept by the rotor blades 52, transfers some of its energy to the rotor blades 52, and is propelled back to the rotor channel 54. This results in the fluid taking a single helical, screw-like path 66 as it circulates through the rotor structure of FIG. 1 and FIG. 3. The path 66 is shown perspectively to more effectively show the helical nature of the flow. The fluid passes through the rotor a number of times, each time transferring more energy to the rotor from the fluid stream by the repeated restoration of energy to the fluid which is leaving the rotor structure 48 from fluid in the rotor fluid channel 54. As a result of the fluid energy transfer to the rotor structure 48, the fluid pressure in the outlet region 58 is less than the fluid pressure in the inlet region 56. The turbine efficiency depends on the pressure differential between the inlet and the outlet. The curved end surface 57 of the separator portion 59 of the rotor housing helps to separate the higher pressure fluid of the rotor channel inlet region 56 from the lower pressure fluid of the rotor channel outlet region 58.

The auxiliary fluid inlet 62 shown in FIG. 1 and FIG. 3 provide fluid to the rotor channel outlet region 58. In operation as shown in FIG. 3 by the dotted flow streamline, the auxiliary fluid flow enters the outlet region 58 from inlet 62 in a direction tangential to the helical direction of the fluid which has entered the rotor channel from the rotor channel inlet region 56. The increased speed of the auxiliary fluid serves to decrease the outlet pressure of the turbine. The auxiliary fluid flow also intensifies the action of the fluid flow acting on the rotor blades to increase energy transfer to the rotor structure 48. If the motion of the fluid through the rotor channel is described as a screw-like motion, the effect of the auxiliary fluid flow on the fluid in the outlet region 58 is to decrease the lead of the screw motion so that the effective number of stages, or number of times the fluid enters the turbine, is increased. The resultant lower outlet pressure results in an overall greater pressure ratio across the turbine. The efficiency and power output of the turbine are thereby increased by the admission of the auxiliary fluid flow as described.

When two columns of rotor blades **52*a* are utilized as shown in FIG. 6 of the drawings, two helical fluid paths are generated with fluid leaving the blades and entering the clear space between the columns of blades. Each of the two oppositely rotating fluid flows thereby generated is fed with an auxiliary fluid flow respectively from the auxiliary inlets 62, 62*a* shown in FIG. 6 of the drawings. A number of columns of blades, each with a separate auxiliary fluid inlet may also be provided. FIG. 6 shows dotted fluid flow streamlines for two auxiliary fluid flows, each enhancing one of the helical fluid flows created by one of the two columns of rotor blades 52*a***.

A plurality of rotor housings 44, each having one or more columns of rotor blades with an auxiliary inlet slot for each column, may be contained with an overall turbine housing similar to the housing 14 with the rotor of each attached to a common shaft.

Many of the high-energy fluid flows occurring in nature have intermittent flow characteristics. Examples of these are tidal currents and wind currents. Because of the intermittent flow of these sources, the regenerative turbine as described hereinabove may be adapted to operate from another source of high-energy fluid flow, which other source may be considered as secondary to the primary naturally occurring, but intermittent, fluid source. Examples of such secondary fluids are heated water, steam and air from solar collection heaters, fluids from commercial boilers, and high-energy fluids obtained by means of direct energy conversion devices. A secondary high-energy nozzle 70 is shown in FIG. 1 of the drawing. The secondary nozzle 70 delivers a secondary high-energy fluid when required from a suitable source (not shown) to the primary fluid inlet 60 of the turbine.

Figure 4:
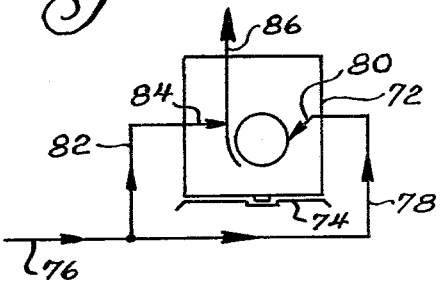
FIG. 4 is a schematic representation of an open-cycle regenerative turbine according to the invention.

FIG. 4 of the drawings schematically depicts an open-cycle regenerative turbine 72 mounted on a pivotal base 74 such as the base 12 depicted in FIG. 1 of the drawings. The arrowheads shown in the schematic representation of FIG. 4 show the direction of fluid flow. Fluid from an appropriate source (not shown) enters an inlet conduit 76. A portion of the fluid flow is guided by a primary fluid conduit 78 to a primary turbine inlet 80. A portion of the fluid from the inlet conduit 76 is directed through an auxiliary fluid conduit 82 to an auxiliary turbine inlet 84. The flow of auxiliary fluid, as described hereinabove, improves the performance of the regenerative turbine 72. Fluid exits from the regenerative turbine 72 through an exit conduit 86 with none of the exit fluid being recycled to the inlet conduit 76.

Figure 5:
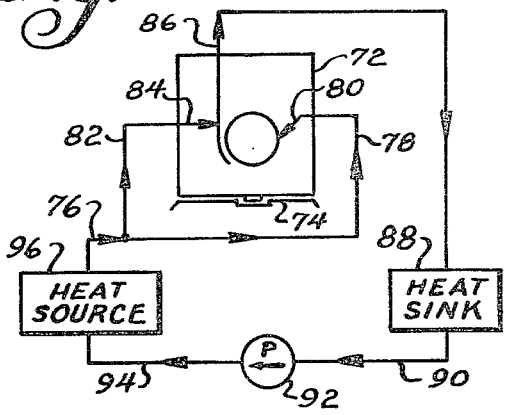
FIG. 5 is a schematic representation of a closed-cycle regenerative turbine according to the invention.

A schematic representation of a closed-cycle regenerative turbine is shown in FIG. 5 of the drawings. FIG. 5 of the drawings is similar to FIG. 4 and similar numerals are used to designate like elements. Fluid enters the regenerative turbine 72 of FIG. 5 at the inlet conduit 76 and exits at the exit conduit 86. The fluid in the inlet conduit 76 of the turbine of FIG. 5 is fed to the primary fluid conduit 78 and the auxiliary inlet conduit 82. Fluid exiting from the regenerative turbine 72 exit conduit 86 of the turbine of FIG. 5 is fed to a heat sink 88 which is at a relatively low energy level. Fluid is drawn from the heat sink 88 through a conduit 90 by means of a suitable pump 92 and delivered through a conduit 94 to a heat source 96 wherein energy is added to the fluid. The outlet of the heat source is connected to the turbine inlet conduit 76. In operation fluid flows through the regenerative turbine 72 and is recirculated by the pump 92 back to the inlet of the regenerative turbine.

While particular embodiments of the system according to the invention have been shown and described, it should be understood that the invention is not limited thereto since many modifications may be made. It is therefore contemplated to cover by the present application any and all such modifications that fall within the true spirit and scope of the basic underlying principles disclosed and claimed herein.

What is claimed is:

1. An improved fluid-driven regenerative turbine comprising:

a rotor;

a housing having a rotor channel with the rotor mounted therein; the rotor channel having a primary driving fluid inlet region and a fluid outlet region; at least some of the primary driving fluid transferring energy to the rotor and flowing through the rotor channel in a helical path;

a primary fluid inlet channel in the housing providing primary driving fluid to the rotor channel primary fluid inlet region;

an auxiliary fluid inlet channel in the housing for providing auxiliary fluid to the rotor channel outlet region in a direction tangential to the helical path of the primary driving fluid in the rotor channel outlet region so that the helical motion of the fluid in the rotor channel outlet region is intensified.

2. The regenerative turbine of claim 1 including a first nozzle positioned between the primary fluid inlet channel and the rotor channel inlet region.

3. The regenerative turbine of claim 1 wherein the driving fluid in the primary fluid inlet channel is maintained at near stagnation conditions.

4. The regenerative turbine of claim 1 wherein the rotor includes a plurality of radially extending rotor blades.

5. The regenerative turbine of claim 4 wherein one or more columns of rotor blades are arranged around the circumference of a cylindrical rotor with the rotor blade working surface extending parallel to the rotor axis; each column of blades having associated therewith a helical fluid flow path and an auxiliary fluid inlet channel providing auxiliary fluid for intensifying helical motion of fluid in the rotor channel outlet region.

6. The regenerative turbine of claim 1 including a separation block extending from the housing to near the rotor to provide separation between the high pressure driving fluid in the primary fluid inlet region of the rotor channel and the lower pressure fluid in the outlet region of the rotor channel and to minimize fluid leakage therebetween.

7. The regenerative turbine of claim 1 operating from a source of driving fluid having a variable direction of flow and a base to which the housing is pivotably mounted so that the primary fluid inlet channel is adapted to being aligned to receive driving fluid from the source direction of flow.

8. The regenerative turbine of claim 1 including a secondary source of a secondary driving fluid and a second nozzle for introducing the secondary driving fluid into the primary fluid inlet region of the rotor channel.

9. The regenerative turbine of claim 1 including the rotor coupled to a shaft and including a plurality of regenerative turbine rotors all coupled to the shaft, the fluid flowing through each rotor in a helical path with auxiliary fluid being provided to each rotor.

10. The regenerative turbine of claim 1 wherein the rotor channel increases in cross-sectional area from the primary fluid inlet region to the fluid outlet region.

11. The regenerative turbine of claim 1 wherein driving fluid flows from the rotor channel outlet region to the primary and auxiliary fluid inlet channels in the housing to provide closed-cycle fluid flow.

12. The regenerative turbine of claim 11 including:

a heat sink in fluid communication with the rotor channel outlet region;

a fluid pump receiving at an inlet thereof fluid from the heat sink and delivering fluid to an outlet;

a heat source receiving fluid from the pump outlet and adding energy to the fluid, the heat source delivering fluid to the primary and auxiliary fluid inlet channels.

13. A method for providing improved operation of a regenerative turbine having one or more rotors comprising the steps of:

introducing a primary driving fluid to a fluid inlet of each turbine rotor channel; and introducing an auxiliary fluid to each of the turbine rotor channel outlets in a direction tangential to the helical path of the primary fluid associated with each rotor to intensify the helical motion of the primary fluid.

14. The method of claim 13 including the step of providing a secondary driving fluid to the fluid inlet channel of one or more of the turbine rotors.

* * * * *